US005139231A

United States Patent [19]

Temple

[11] Patent Number: 5,139,231

[45] Date of Patent: Aug. 18, 1992

[54] LUMBER JACK

[76] Inventor: Jeffrey L. Temple, 18557 Zolman Rd., Fredericktown, Ohio 43019

[21] Appl. No.: 514,975

[22] Filed: Apr. 26, 1990

[51] Int. Cl.[5] ..... B66F 3/00

[52] U.S. Cl. ..... 254/15; 254/16; 254/113

[58] Field of Search ..... 254/11, 15, 16, 113, 254/133.2, 17

[56] References Cited

U.S. PATENT DOCUMENTS

| | | | |
|---|---|---|---|
| 32,120 | 4/1861 | Clough | 254/15 |
| 396,104 | 1/1889 | Morrill | 254/15 |
| 721,681 | 5/1903 | Early | 254/15 |
| 889,104 | 5/1908 | Buchler | 254/16 |
| 1,911,705 | 10/1931 | McMullan | 254/15 |
| 2,351,691 | 8/1943 | Mansir | 254/15 |
| 2,427,268 | 9/1947 | Fleming et al. | 254/15 |
| 2,625,368 | 1/1953 | Warner | 254/15 |
| 2,780,437 | 6/1954 | Ham | 254/15 |
| 2,823,011 | 2/1958 | Jones | 254/15 |
| 3,203,668 | 3/1964 | Pitsenbarger | 254/15 |
| 3,331,584 | 7/1967 | Schwartz | 254/15 |
| 3,524,623 | 5/1968 | Campbell | 254/15 |

*Primary Examiner*—J. J. Hartman

*Attorney, Agent, or Firm*—Watkins, Dunbar & Pollick

[57] ABSTRACT

A jack for forcing adjoining boards or sheathing into close proximity or contact with one another and holding them in such a position while they are fastened to supporting joists or rafters. The device consists of a housing that is adapted to engage the joist or rafter. A slot is formed lengthwise in the housing and adjoins a side of the joist or rafter. A wedge is positioned in the slot so as to wedge itself between the housing and the supporting joist or rafter and hold the tool in a fixed position relative to the supporting joist or rafter. A lever is pivotally attached to the housing and has an attached pusher to engage the edge of a board or sheathing and move it into proximity or contact with an adjoining board that has been already affixed to the joist or rafter. A simple wedge or inclined plane minimizes the number of moving parts in the invention and produces a wedging force proportional to the force being used to move the board in contact with an adjoining board. A spring holds the wedge in the slot.

20 Claims, 3 Drawing Sheets

FIG. 5
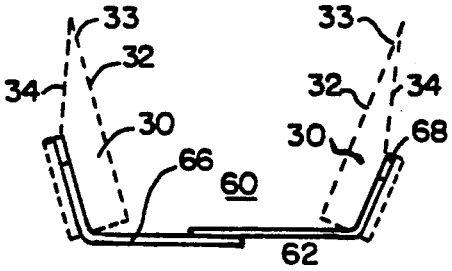
FIG. 4
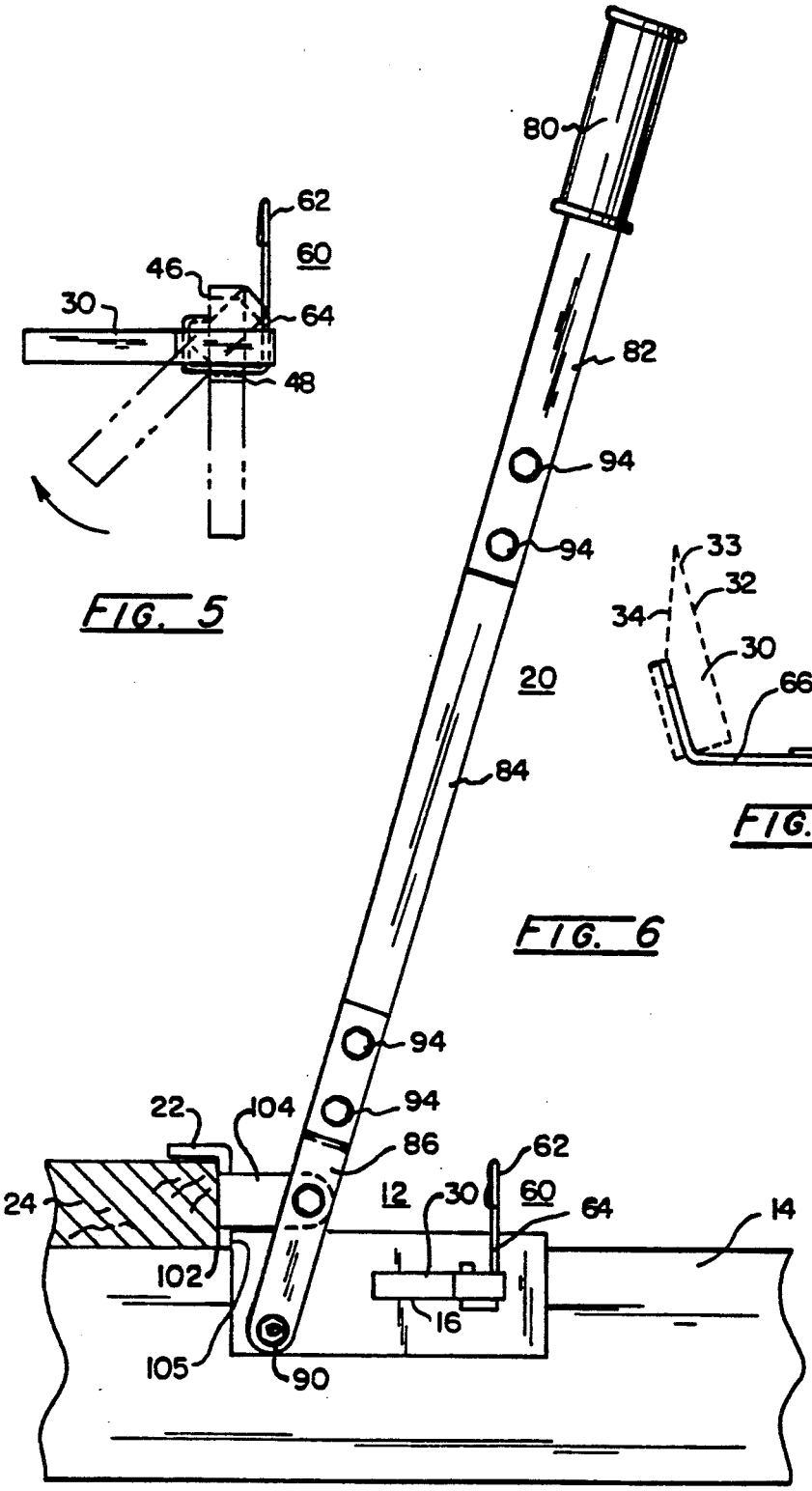
FIG. 6

LUMBER JACK

FIELD OF THE INVENTION

This invention relates to carpenter's tools. More particularly, it relates to a hand tool useful for bring boards, sheathing and similar members into proximity or contact with one another such as in the construction of floors and the installation of sheathing for roof construction.

BACKGROUND OF THE INVENTION

Generally the prior art reveals two types of tools for installing decking or sheathing—devices based on spikes or prongs to engage the tool with supporting members and devices based on a mechanism for clamping the tool to supporting members. Illustrative of the prong devices are:

U.S. Pat. No. 3,524,623 to Campbell where the tool has prongs that dig into the subflooring in order to exert force on the boards being laid. U.S. Pat. No. 3,331,584 to Schwartz reveals a cam-lever type floor jack that pivots about spiked members that dig into the underside of the joist. U.S. Pat. No. 3,203,668 to Pitsenbarger relates to a flooring jack for installing tongue and groove boards. This device relies on a pointed end of the tool being driven into the subfloor and supplying leverage for a push rod. U.S. Pat. No. 2,823,011 to Jones shows a sliding tool that is anchored to a stud or similar member with a prong.

Illustrative of the clamping devices are:

U.S. Pat. No. 2,780,437 that discloses a device that clamps to the joist. U.S. Pat. No. 2,625,368 to Warner reveals a jack that also depends on being clamped to the joist. U.S. Pat. No. 2,351,691 to Mansir relates to a lumber puller that relies on cams to engage and clamp the tool to the sides of a joist. U.S. Pat. No. 1,911,705 to McMullan shows a cramp for floorboards that utilizes two dogs to grip the sides of a joist. U.S. Pat. No. 721,681 to Ulrey discloses a flooring clamp that uses pawls to engage the joist from opposite sides and clamp the device thereto. U.S. Pat. No. 32,120 to Clough reveals a clamp-device for laying floorboards.

Generally, the prong or spike type devices do considerable damage to the joist or subfloor with which they are used. As such they mar the wood and create splinters that may be unsightly as well as dangerous on a construction such as an open deck. On the other hand, the clamping devices are mechanically complex and subject to bending and breaking, especially when it is necessary to apply significant force such as might be necessary with a badly warped board.

SUMMARY OF THE INVENTION

The present invention overcomes these and other difficulties found in the prior art devices by providing an invention that is simple in construction yet enables the application of substantial force in assembling badly warped or deformed boards and similar parts and maintaining them in a fixed position while fastening them to supporting members.

The tool of this invention is widely adjustable so as to accommodate the varying width and thicknesses of boards, sheathing, joists, rafters and similar members in conjunction with which it is used. In addition, a special wedge component wedges the frame of the tool to a supporting joist or like member and maintains the tool stationery by providing a wedging force that is proportional to the force required to manipulate the board being fixed into place. The board is manipulated by a lever pivotally attached to the frame.

The pressure-exerting jack of this invention is used for forcing joining members such as boards, sheathing and the like that are supported on a joist, rafter or like member into close proximity or contact with one another while they are fastened to a supporting member such as a joist, or rafter or the like. The device of this invention has a frame or housing that is adapted to engage and conform generally to the joist, rafter or other supporting-type member and has at least one lengthwise slot in the frame or housing that is adjoining to a side of the joist, rafter or other supporting member. A wedge (inclined plane) is placed in the frame slot so as to wedge between the side of the joist, rafter or like member and the inside of the frame and hold the housing in a stationary or fixed position relative to the supporting joist, rafter or like member.

A lever is pivotally attached to the housing and is used alone or in conjunction with a pusher that is attached to the lever to engage the edge of a board, sheathing or similar member supported on the joist and to move that member in proximity or contact with an adjoining member that is supported and attached to the joist, rafter or like member. The lever is also used to maintain the board, sheathing or like member in proximity or in contact with the affixed member while it is also being attached to the joist, rafter or like member.

The wedging means is typically a simple wedge, ramp, or inclined plane having three sides. A first side of the triangular wedge member contacts a side of the joist, rafter or similar member. The first side of the wedge member can have a plurality of ridges for gripping the side of the joist, rafter or like member, so as to prevent slippage of the wedge member and tool when force is applied to the board. The second side (the ramp or inclined side) of the wedge member slants away from the plane of the first side of the wedge. A portion of the second side contacts an inner side of the frame so that the frame and the side of the joist are wedged into a stationary or locked position with each other. A third side joins the first and second sides of the wedge member to form a triangular shape.

In order to maintain the wedge in the frame or housing slot, it can be made slightly longer than the slot. A post projects perpendicularly from the third side near the end of the third side where the third side meets the first side fits the wedge in the slot. The narrow portion of the wedge, since it longer than the slot, contacts the inner side of the frame. The post at the opposite end, i. e., projecting from the third side, engages the inner side of the frame at the opposite end of the slot. As a result, the wedge is secured within the slot and prevented from being withdrawn in a generally outward and perpendicular direction from the slot. In order to prevent the wedge from falling into the slot, that is, in an inward direction, a spring means is used to bias the wedge in a direction generally out of the slot so as to bring the second side of the wedge in an area near the narrow portion of the wedge and the post in contact with the inner side of the frame at each end of the slot thereby holding the wedge in place in the slot. Other methods of holding the wedge in the slot are possible and thus the above description is illustrative but not limiting.

Preferably, at least of pair of slots and two wedges are used with this device. The slots are on generally opposite sides of the frame so as to be adjoining the opposite sides of the joist, rafter or like member. Additional wedges are similar to the one already previously described. With two wedges, a single spring means can be used to hold both wedges in their respective slots. When the spring means is attached to both wedges in the area where the second and third sides of the wedge meet, it is possible to eliminate the wedge post previously described. A spring means such as a spring with two ends bridges the frame member with each of the ends extending downward to engage the wedge members. The ends of the springs can be joined to the wedge by forming the ends into a partially open structures. These partially open structures are generally round or oblong in shape so as to conform to the shape of the wedge in the area where the second and third sides meet. The partially open structures are oriented (rotated) in such a fashion as to point away from the frame at their outermost ends.

Slits are cut into the wedge, one on the third side of the wedge and a second on the second side of the wedge, so that the two slits are in general alignment with each other so that the slits can receive and be held in the partially open structure formed in the ends of the spring coil. The slight outward rotation of the partially open structure of the end of the spring causes the second side of the narrow end of the wedge to be brought in contact with the inner side of the frame near the end of the slot. This outward bias of the narrow end of the wedge helps to free it from the joist or rafter after the board or sheathing has been fixed in place. Proper adjustment of the distance between the two ends of the spring where they first meet the wedge near the third side of the wedge maintains that area of the wedge in proper position in the slot.

Other means for joining the ends of the spring to the wedge are possible. For example, a hole in the third side and perpendicular thereto could receive the end of the spring in a force fit. A similar hole, but through to the second side, could receive the end of the spring in a loose fit with a suitable means for retaining the spring on the wedge, for example, a cap or a right angle bend on the end of the spring where it emerges from the second side of the wedge. However, that which is shown and described is preferred.

The jack lever can be attached to the frame by means of a U-shaped extension formed at one end of the lever. The U-shaped extension bridges the frame with the legs of the U-shaped extension being attached to opposite sides of the frame in a pivoting fashion. Preferably, the pusher is attached to the legs of the U-shaped extension of the lever so as to generally be in the plane of the boards to be held in place. The pivotal attachment allows the pusher to be used with board, sheathing and the like with wide ranges of thickness. The pusher can also have a lip that extends in a downward direction and that contacts the front edge of the frame so as to limit the rotational travel of the lever in a backward direction.

In a preferred embodiment of the invention, the housing frame is a U-shaped configuration conforming generally in shape to the edge and two side of a joist, rafter or like member. Typically, this U-shaped housing frame has first and second downwardly extending legs with the two legs being joined by a top member. A pair of slots is formed lengthwise in the legs of the housing frame generally opposite each other and adjoining opposite sides of the joist, rafter or like member. A wedging means is positioned in each of slots so as to hold the housing frame in a stationary, fixed position relative to the supporting joist, rafter or like member. A lever with a U-shaped structure at one end, is pivotally attached to the legs of the housing frame. A pusher is pivotally attached to the legs of the U-shaped frame above the top of the housing frame so as to engage the edge of a board supported on the joist and move it into close proximity or contact with an enjoining member or board affixed to the joist or rafter. The point of pivotal attachment of the pusher and lever are relatively close together so as to minimize the forces causing the tool to rotate about the push plate and be lifted from the joist or rafter.

It is a purpose of this invention to accomplish the necessary locational adjustments of the tool and push plate without the aid of any auxiliary mechanisms in a simple and efficient manner.

It is a further purpose of this invention to accomplish this with a consistent reliability.

It is a further purpose of this invention to accomplish these objectives while minimizing the mechanical complexity of the apparatus and thereby increasing its reliability and operating life.

Other objects and features of the invention will be apparent and understood from the detailed description of the invention and the accompanying drawings which follow.

The foregoing and other advantages of the invention will become apparent from the following disclosure in which a preferred embodiment of the invention is described in detail and illustrated in the accompanying drawings. It is contemplated that variations and procedures, structural features, and arrangement of parts may appear to the person skilled in the art without departing from the scope or sacrificing any of the advantages of the invention.

BRIEF DESCRIPTION OF THE DRAWINGS

FIG. 4 is a top view of the spring showing the outward bias at the ends of the partially open structure that holds the tips of the wedges against the inside wall of the tool housing.

FIG. 5 is a side view of the spring and wedge showing the partially open housing at the end of the spring for receiving the wedge.

FIG. 6 is a side view of this invention showing the lip on the push plate in contact with the edge of the device housing so as to limit the rearward travel of the handle.

DETAILED DESCRIPTION OF THE INVENTION AND BEST MODE FOR CARRYING OUT THE PREFERRED EMBODIMENT

Figure 1:
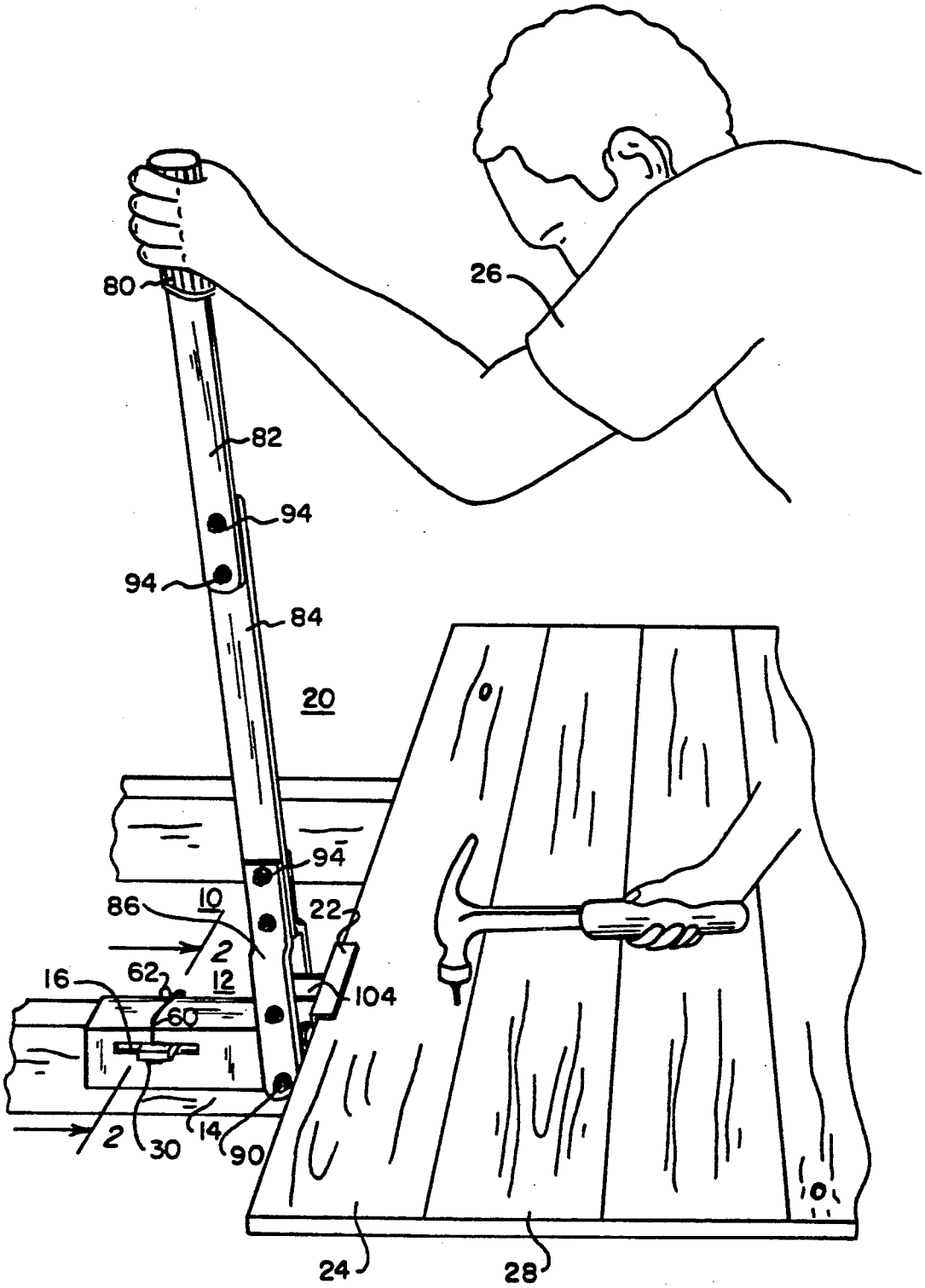
FIG. 1 is a perspective view of this invention showing its operation in conjunction with a joist to hold a floorboard in place while permanently attaching the floorboard to the joist.

As shown in FIG. 1, the device of this invention is denoted by the numeral 10 and consists of a frame or housing 12 that generally conforms to the shape of a joist or other support member 14, and which has a lengthwise slot 16 that is next to or adjoins the joist member 14, a wedging means generally denoted by the numeral 18, a lever 20 pivotally attached to the housing 12 and a pusher 22 attached to the lever 20 and engaging the edge of a board or similar member 24 supported on the joist 14.

Figure 2:
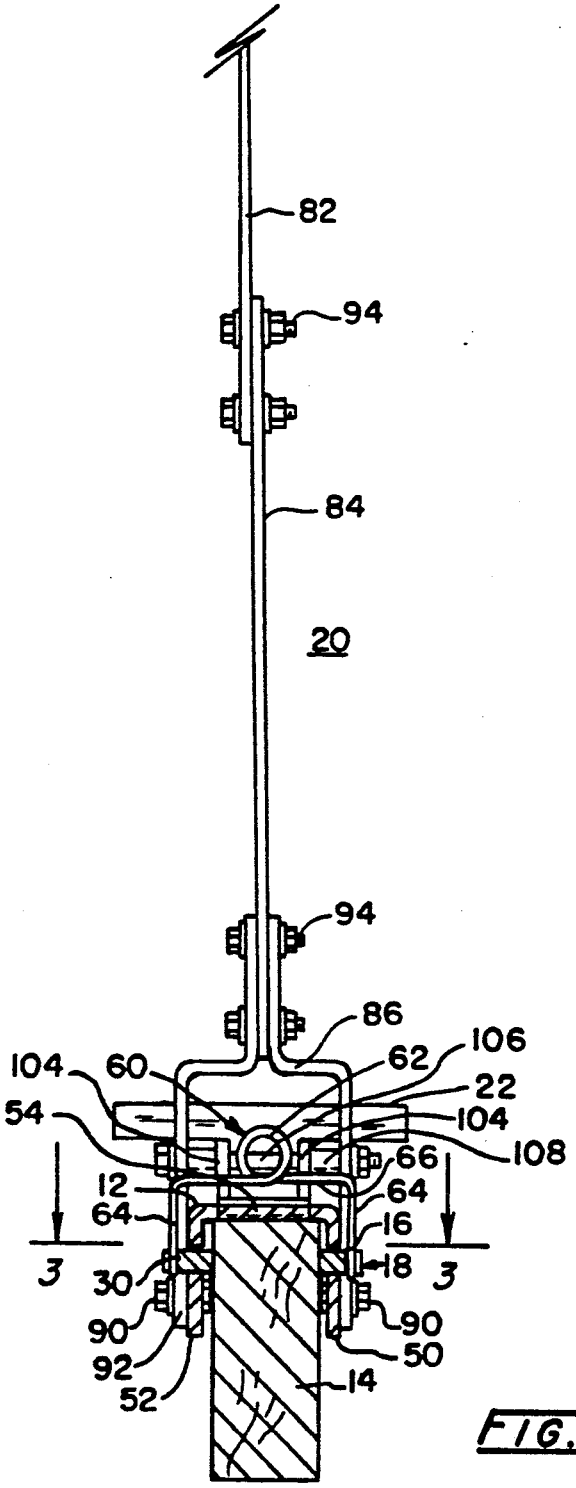
FIG. 2 is a section view of this invention taken along lines 2—2 of FIG. 1.

As shown in FIG. 2 the frame 12 is of a shape to generally conform to the joist, rafter or other supporting member 14. The housing frame 12 is a U-shaped housing that conforms to the edge and two adjacent sides of the joist or other supporting member 14. The U-shaped housing 12 typically has a first downward extending leg 50 and a second downward extending leg 52 that adjoin opposite side of the joist, rafter or other supporting member 14.

The housing 12 typically has at least one lengthwise slot 16 that adjoins the side of the joist 14. Although only one slot is necessary, preferably a pair of slots, one in each of the frame legs 50 and 52 and generally across from each other and adjoining the sides of the joist or like member 14 are preferred. The lengthwise slot 16 is formed so as to receive the wedging means 18 and allows it to wedge between joist 14 and the interior surface of frame 40 legs 50 or 52.

Figure 3:
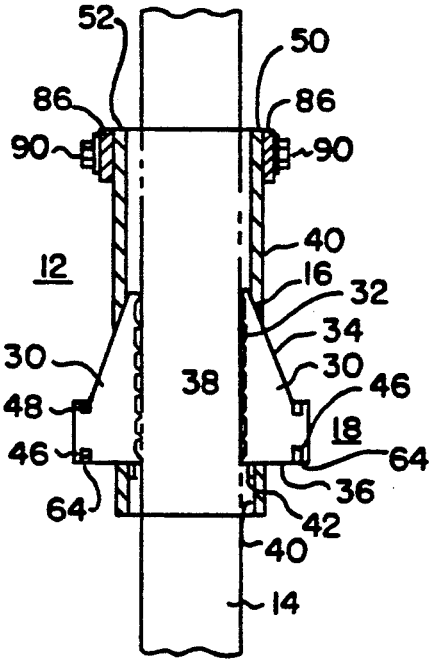
FIG. 3 is a section view of this invention taken along lines 3—3 of FIG. 2 showing the operation of the wedges in wedging the device against the joist.

As shown in FIG. 3, the wedging means 18, comprises a triangular wedge (inclined plane or ramp) 30 that consists of a first side 32 for contacting the side of the joist or like member 14, a second side 34 that slants away from the plane of the first side and is able to contact an inner side 40 of one of the frame legs 50 or 52 so that the wedge member 30 can wedge itself between the frame leg 50 or 52 and the joist, or like member, 14, and finally a third side 36 that joins side 34 and side 32 to form a generally triangular member 30. Side 32 may have ridges 38 for better gripping the surface or joist or like member 14.

As shown in FIG. 3, the length of first side 32 of wedge 30 can be somewhat longer than the slot 16. The third side 36 of the wedge 30 can also have a post 42 that projects at a right angle to side 36 and is positioned near the edge of side 36 that is near the first side 32. The post 42 contacts the inner side 40 of one of the legs 50 or 52. The slightly longer length of side 32 of the wedge 30 in relation to the slot 16 and the projecting post 42 which also contacts the inner side 40 of the frame 12 prevent the wedge 30 from moving outwardly from the frame slot in a direction generally perpendicular to the slot 16.

Generally a suitable means is used to maintain the wedge member in the slot 16. Such a means may be a spring means such as spring means 60 shown in FIGS. 1, 2, 4, 5 and 6. As seen in FIG. 2, spring means 60 consists of a spring coil 62 and a section of the ends of the spring coil 66 that bridge the top or cross member 54 of the frame 12. After bridging the top or cross member 54, the ends of the spring are bent downward at a right angle to the bridging section 66 so that each lower portion of sections 64 is received into slot 46 of wedge member 30. When the distance between downward opposing sections (FIGS. 3 and 4) 64 is properly adjusted by bending sections 64 toward or apart from each other, the wedges are positioned in the slot so as to be far enough apart to allow placement of joist 14 between them but not so far apart that they fall out of the slot.

As shown in FIGS. 5 and 6, the ends of the spring are bent into a partially open structure for receiving the wedge 30. As further seen in FIG. 4, the outermost end 68 of the partially open structure is biased outward so that the partially open structure forms an obtuse angle with the plane of the bridging section 66. The outward bias tends to bring the second side of the wedge near the tip 33 in contact with the inner side 40 of leg 50 or 52. As the inner side 40 of legs 50 and 52 slide up wedge side 34 when handle 80 is pulled forward, side 32 is forced into ever tighter contact with joist 14. When handle 20 is released, the frame returns to its former position and leaves a gap between side 40 and the wedge. This outward bias of spring end 68 tends to free wedge side 32 from the joist and bring side 34 in contact with frame innerside 40.

To cooperate with the partially open structure at the end of the spring shown in FIGS. 5 and 6, the second and third sides of the wedge 30 have slits 48 and 46 (FIG. 3) cut into them. The slits 48 and 46 are cut into the second and third edges of the wedge and are across from each other and aligned with each other so as to receive the partially open structure formed in the ends of the spring coil. As shown in FIG. 5, the slit 48 on the second side engages the end of the spring. The wedge is then rotated so that the slit 46 in the third side can engage the partially open structure of the spring means 60. Because of the outward bias of the open structure, the second side 34 of the wedge near the pointed end of the wedge is maintained in contact with the inner side 40 of the legs 50 or 52. In order to aid in the insertion of the wedge 30 into the open structure at the end of the spring, it is desirable to square off the second side 34 of the wedge in the area where it meets the third side 36 of the wedge 30. This also eliminates any potential hazard of a projecting sharp wedge corner where the second and third sides of the wedge meet.

As shown in FIGS. 1, 2 and 6 the lever 20 can be formed in more than one section. For example, as illustrated, the lever 20 consists of a first section 82, a second section 84, a handle 80 placed over the end of the first section 82 and two legs 86 attached at the other end of section 84 and forming a U-shaped member that bridges the frame 12 and is pivotally attached thereto with pivot pins 90. These lever sections are joined to each other with suitable fastening means such as nuts and bolts 94. A suitable bushing 92 can be used between the pivot pin 90 and the leg 86 so as to minimize the wear on pivot pin 90. As is apparent in FIG. 2, the legs 86 of the handle are joined to the frame legs 50 and 52 by separate pivot pins 90 through each of the legs 50 and 52. This enables the device to span the joist, rafter or like member.

The pusher 22 has a lip 102 joined to it at right angles and extending in a downward direction. As shown in FIG. 6, the lip 102 contacts the front edge 105 of the frame housing 12 so as to limit the rearward travel of the handle 20. Two legs 104 are attached at right angles to lip 102 and project in a rearward direction and are joined at their ends to legs 86 by means of a pivot pin 106. Bushings 108 are placed between the handle leg 86 and the pusher leg 104 so as to limit the lateral motion of the pusher 22 along pivot pin 106.

The operation of the device 10 is best illustrated in FIG. 1. The frame 12 is placed over the joist 14 with the pusher 22 engaging the edge of board 24 and the lever 20 in a perpendicular or somewhat rearward orientation. The operator 26 pulls the coil 62 forward (to the right in FIG. 1) to urge the attached wedging means 18 between the inside of the frame 12 and the side of the joist so as to initially wedge the tip 33 between the joist 14 and the inner side 40 of leg 50 and 52 with sufficient force to prevent the frame 12 and wedge 30 from sliding along joist 14. The operator 26 then pulls the lever 20 toward him, causing the frame 12 to move backward and slide up side 34 of wedge 30 until the frame 12 is firmly wedged against the side of joist 14 so as to render it in a fixed and secure position. As the operator continues to pull the lever 20 toward him, the pusher pushes board 24 in proximity or contact with board 28 which has already been nailed or otherwise attached to joist 14. Int he case of a warped board, greater forward force on lever 20 will produce a proportional backward force on the frame 12 causing it to be even more firmly wedged to the joist 14.

It may be possible that minor changes in configurations to other tan those shown could be used but that which is shown is preferred and typical.

Without departing from the scope of this invention, various means of fastening the material together may be used.

It is to be understood that although the present invention has been specifically disclosed with the preferred embodiment and examples, modifications to the design concerning sizing and shape may be apparent to those skilled in the art, and such modifications and variations are considered to be within the scope of the invention and the appended claims.

I claim:

1. A pressure-exerting jack for forcing adjoining members supported on a supporting member into fixed position with one another and comprising:

a. a U-shaped frame conforming to an edge and adjacent sides of said supporting member and having a slot formed therein;

b. a wedge member partially contained in said slot comprising:

1) a first side for contacting said supporting member, 2) a second side, slanting away from the plane of said first side, for contacting an inner side of said frame so that said first side and said second side of said wedge member wedge between said supporting member and said inner side of said frame to hold said frame in a fixed position relative to said supporting member, and 3) a third side joining said first side and said second side of said wedge member; and c. spring means attached to said wedge member for 1) maintaining a portion of said wedge member in said slot and 2) positioning said first side and said second side of said wedge member to wedge between said inner side of said frame and said supporting member; and d. a lever pivotally attached to said frame with means for engaging a member supported on said supporting a member so as to move said supported member into a fixed position with an adjoining member affixed to said supporting member.

2. A pressure-exerting jack according to claim 1 with said first side of said wedge member having a plurality of ridges for gripping said supporting member.

3. A pressure-exerting jack according to claim 1 where said means for engaging members supported on said supporting member is a pusher attached to said lever.

4. A pressure-exerting jack according to claim 1 with:

a. the length of said first side of said wedge member being longer than the length of said frame slot and b. said spring means holding said second side of said wedge in contact with said inner side of said frame.

5. A pressure-exerting jack according to claim 4 with said wedging member further comprising a post projecting at a right angle to said third side, said post being positioned near an edge of said third side adjacent to said first side and contacting an inner side of said frame so as to prevent said wedge member from moving outwardly from said frame slot.

6. A pressure-exerting jack according to claim 1 further comprising:

a. a second slot formed in said frame opposite said first slot;

b. a second wedge member partially contained in said second slot comprising:

1) a first side for contacting said supporting member, 2) a second side, slanting away from the plane of said first side, for contacting an inner side of said frame so that said first side and said second side of said wedge member wedge between said supporting member and said inner side of said frame so as to hold said frame in a fixed position relative to said supporting member, and 3) a third side joining said first side and said second side of said wedge member; and c. spring means attached to said wedge member for:

1) maintaining a portion of said wedge member in said slot and 2) positioning said first side and said second side of said wedge member to wedge between said inner side of said frame and said supporting member.

7. A pressure-exerting jack according to claim 6 with said first side of said wedge member having a plurality of ridges for gripping said supporting member.

8. A pressure-exerting jack according to claim 6 with the length of said first side of said wedge and second wedge members being longer than the length of their respective frame slot and said spring means attached to said wedge member holding said second side of said wedge member in contact with said inner side of said frame and said spring means attached to said second wedge member holding said second side of said second wedge member in contact with said inner side of said frame.

9. A pressure-exerting jack according to claim 6 with said spring means for maintaining said wedge member in said slot and said spring means for maintaining said second wedge member in said second slot being a single spring means.

10. A pressure-exerting jack according to claim 9 with said single spring means comprising:

a. a spring coil;

b. a first end and a second end of said spring coil extending from said spring coil so as to bridge said frame and then each end extending downward on opposite sides of said frame; and c. means for attaching said first end of said spring coil to said wedge member and said second end of said spring coil to said second wedge member.

11. A pressure-exerting jack according to claim 10 with said means for attaching said first end of said spring coil to said first wedge member and said second end of said spring coil to said second wedge member comprising:

a. a partially open structure formed in each of said first and second ends of said spring coil and extending generally along and away from said frame, b. a first slit in said third side of each of said wedge members and a second slit in said second side of each of said wedge members with said first slit and said second slit being opposite each other so as to receive and be held in said partially open structure formed in each of said first and second ends of said spring coil, and c. the length of said first side of said wedge and said second wedge members being longer than the length of their respective frame slots.

12. A pressure-exerting jack according to claim 3 wherein said pusher is pivotally attached to said lever.

13. A pressure-exerting jack according to claim 3 with said lever further comprising a U-shaped extension attached at one end of said lever with said U-shaped extension bridging said frame and legs of said U-shaped extension extending along opposite sides of said frame and being pivotally attached thereto.

14. A pressure-exerting jack according to claim 13 wherein said pusher is pivotally attached to said legs of said U-shaped extension above said frame.

15. A pressure-exerting jack according to claim 14 with said pusher further comprising a downwardly extending lip movably contacting an edge of an end of said frame so as limit the rotational travel of said lever.

16. A pressure-exerting jack for forcing adjoining members supported on a supporting member into fixed position with one another comprising:

a. a U-shaped housing frame that engages said supporting member and having:
   1) a first downwardly extending leg,
   2) a second downwardly extending leg, and
   3) a top joining said first and second legs;

b. a first slot formed in said first leg of said housing frame and a second slot formed in said second leg generally opposite said first slot;

c. a first wedge partially contained in said first slot and a second wedge partially contained in said second slot with each of said wedges comprising:
   1) a first side for contacting said supporting member,
   2) a second side, slanting away from the plane of said first side, for contacting an inner side of said frame so that said first side and said second side wedge between said supporting member and said inner side of said frame so as to hold said housing frame in a fixed position relative to said supporting member; and
   3) a third side joining said first side and said second side of said wedge;

d. a spring means attached to said first wedge and to said second wedge for:
   1) maintaining a portion of each of said wedges in their respective slots and
   2) positioning said first side and said second side of each of said wedges to wedge between said inner side of said frame and said supporting member;

e. a lever with a U-shaped frame attached at one end with said U-shaped frame having legs extending downward along said sides of said housing frame and being pivotally attached thereto; and f. a pusher pivotally attached to said legs of said U-shaped lever frame above said top of said housing frame and engaging an edge of said member supported on said supporting member so as to move said supported member into fixed position with an adjoining member supported on said supporting member.

17. A pressure-exerting jack according to claim 16 with the length of said first side of said first wedge being longer than the length of said housing first slot and the length of said first side of said second wedge being longer than the length of said second housing slot.

18. A pressure-exerting jack according to claim 16 with said spring means for maintaining and positioning said wedge members in their respective slots comprising:

a. a spring coil;

b. a first end and a second end of said spring coil extending from said spring coil so as to bridge said top of said housing frame and then first end extending downward along said first leg of said housing frame and said second end extending downward along said second leg of said housing frame; and c. means for attaching said first end of said spring coil to said first wedge and second end of said spring coil to said second wedge.

19. A pressure-exerting jack according to claim 18 with said means for attaching said ends of said spring coil to said wedges comprising:

a. a partially open structure formed in each of said ends of said spring coil and extending generally along and away from said frame, b. a first slit cut into said third side of each of said wedges and a second slit cut into said second side of each of said wedges being in general alignment with each other so as to receive and be held in said partially open structure formed in each end of said spring coil, and c. the length of said first side of each of said wedges being longer than the length of their respective frame slots.

20. A pressure-exerting jack according to claim 16 with said pusher further comprising a downwardly extending lip movably contacting an edge of an end of said frame so as limit the rotational travel of said lever in a direction generally away from said adjoining members supported on said supporting member.

* * * * *